US009068719B2

(12) United States Patent
Van De Ven et al.

(10) Patent No.: US 9,068,719 B2
(45) Date of Patent: Jun. 30, 2015

(54) LIGHT ENGINES FOR LIGHTING DEVICES

(75) Inventors: Antony Paul Van De Ven, Hong Kong (CN); Charles M. Swoboda, Morrisville, NC (US); Wai Kwan Chan, Hong Kong (CN)

(73) Assignee: Cree, Inc., Durham, NC (US)

( * ) Notice: Subject to any disclaimer, the term of this patent is extended or adjusted under 35 U.S.C. 154(b) by 391 days.

(21) Appl. No.: 12/566,857

(22) Filed: Sep. 25, 2009

(65) Prior Publication Data

US 2011/0075411 A1 Mar. 31, 2011

(51) Int. Cl.

| | |
|---|---|
| ***F21S 4/00*** | (2006.01) |
| ***F21V 15/01*** | (2006.01) |
| ***F21S 8/10*** | (2006.01) |
| ***F21V 29/00*** | (2015.01) |
| ***F21V 29/74*** | (2015.01) |
| *F21S 6/00* | (2006.01) |
| *F21S 8/02* | (2006.01) |
| *F21S 8/00* | (2006.01) |
| *F21S 8/04* | (2006.01) |
| *F21S 8/06* | (2006.01) |
| *F21V 21/30* | (2006.01) |
| *F21Y 101/02* | (2006.01) |

(52) U.S. Cl.

CPC .. *F21V 15/01* (2013.01); *F21S 6/00* (2013.01); *F21S 8/02* (2013.01); *F21S 8/033* (2013.01); *F21S 8/04* (2013.01); *F21S 8/06* (2013.01); *F21S 48/328* (2013.01); *F21V 21/30* (2013.01); *F21V 29/004* (2013.01); *F21Y 2101/02* (2013.01); *F21V 29/74* (2013.01)

(58) Field of Classification Search

USPC ..... 362/249.01, 240, 246, 247, 249.02, 362/294, 310, 362, 364, 365, 370, 371, 373, 362/396, 427, 432, 476, 545, 455, 648, 800

See application file for complete search history.

(56) References Cited

U.S. PATENT DOCUMENTS

| | | | |
|---|---|---|---|
| 446,142 | A | 2/1891 | Martin |
| D188,916 | S | 9/1960 | Harling |
| D207,867 | S | 6/1967 | Pettengill |
| 3,560,728 | A | 2/1971 | Atkin |
| 3,755,697 | A | 8/1973 | Miller |
| 3,787,752 | A | 1/1974 | Delay |

(Continued)

FOREIGN PATENT DOCUMENTS

| | | |
|---|---|---|
| CN | 2814129 Y | 9/2006 |
| CN | 101162745 | 4/2008 |

(Continued)

OTHER PUBLICATIONS

U.S. Appl. No. 13/022,978, filed Feb. 8, 2011, Van de Ven.

(Continued)

*Primary Examiner* — Hargobind S Sawhney

(74) *Attorney, Agent, or Firm* — Burr & Brown, PLLC

(57) ABSTRACT

A light engine housing comprising a mixing chamber element, a driver chamber element and/or a connection element, one or more of which is removable. A light engine comprising (1) a light engine housing and (2) a mixing chamber module and/or a driver module removably attached to and/or positioned in the light engine housing. Also, a light engine comprising (1) a light engine housing and a mixing chamber module and/or a driver module. Also, a solid state light engine comprising a light engine housing comprising at least a first connection element.

55 Claims, 8 Drawing Sheets

(56) References Cited

U.S. PATENT DOCUMENTS 4,090,189 A 5/1978 Fisler
4,717,868 A 1/1988 Peterson
4,798,983 A 1/1989 Mori
4,839,535 A 6/1989 Miller
4,841,422 A 6/1989 Groh
4,918,487 A 4/1990 Coulter, Jr.
5,138,541 A 8/1992 Kano
5,151,679 A 9/1992 Dimmick
5,175,528 A 12/1992 Choi et al.
5,345,167 A 9/1994 Hasegawa et al.
5,397,938 A 3/1995 Wilhelm et al.
5,528,467 A * 6/1996 Jiang ..... 362/546
5,631,190 A 5/1997 Negley
5,661,645 A 8/1997 Hochstein
D384,430 S 9/1997 Lecluze
5,736,881 A 4/1998 Ortiz
5,785,418 A 7/1998 Hochstein
5,803,579 A 9/1998 Turnbull et al.
D400,280 S 10/1998 Leen
5,844,377 A 12/1998 Anderson et al.
5,912,477 A 6/1999 Negley
5,912,568 A 6/1999 Kiley
D418,620 S 1/2000 Grossman
D425,024 S 5/2000 Klaus et al.
6,079,852 A * 6/2000 Kamaya et al. ..... 362/287
6,150,771 A 11/2000 Perry
6,161,910 A 12/2000 Reisenauer et al.
D437,439 S 2/2001 Tang
6,222,172 B1 4/2001 Fossum et al.
6,264,354 B1 * 7/2001 Motilal ..... 362/505
6,285,139 B1 9/2001 Ghanem
6,329,760 B1 12/2001 Bebenroth
6,340,868 B1 1/2002 Lys et al.
6,350,041 B1 2/2002 Tarsa et al.
6,362,578 B1 3/2002 Swanson et al.
6,388,393 B1 5/2002 Illingworth
6,400,101 B1 6/2002 Biebl et al.
6,528,954 B1 3/2003 Lys et al.
6,577,072 B2 6/2003 Saito et al.
6,586,890 B2 7/2003 Min et al.
6,600,175 B1 7/2003 Baretz et al.
6,614,358 B1 9/2003 Hutchison et al.
6,636,003 B2 10/2003 Rahm et al.
6,724,376 B2 4/2004 Sakura et al.
D490,181 S 5/2004 Redfern
6,747,420 B2 6/2004 Barth et al.
6,755,550 B1 6/2004 Lackey
6,791,840 B2 * 9/2004 Chun ..... 361/715
6,808,287 B2 10/2004 Lebens et al.
6,836,081 B2 12/2004 Swanson et al.
6,841,947 B2 1/2005 Berg-johansen
6,873,203 B1 3/2005 Latham, II et al.
6,987,787 B1 1/2006 Mick
6,995,518 B2 2/2006 Havlik et al.
7,014,341 B2 3/2006 King et al.
7,038,399 B2 5/2006 Lys et al.
7,071,762 B2 7/2006 Xu et al.
7,081,722 B1 7/2006 Huynh et al.
7,088,059 B2 8/2006 McKinney et al.
7,108,238 B2 9/2006 Gauci
7,119,498 B2 10/2006 Baldwin et al.
7,144,140 B2 12/2006 Sun et al.
7,180,487 B2 2/2007 Kamikawa et al.
7,202,608 B2 4/2007 Robinson et al.
7,213,940 B1 5/2007 Van de Ven
D544,979 S 6/2007 Hartmann et al.
7,226,189 B2 6/2007 Lee et al.
D557,853 S 12/2007 Sandell
D558,374 S 12/2007 Sandell
7,408,308 B2 8/2008 Sawada et al.
D576,964 S 9/2008 Shaner
7,458,706 B1 12/2008 Liu et al.
7,513,639 B2 * 4/2009 Wang ..... 362/218
7,566,154 B2 * 7/2009 Gloisten et al. ..... 362/545
7,614,767 B2 11/2009 Zulim et al.
7,614,769 B2 11/2009 Sell
7,628,513 B2 12/2009 Chiu
7,637,635 B2 12/2009 Xiao et al.
D610,291 S 2/2010 Yoshinobu et al.
7,677,767 B2 3/2010 Chyn
7,703,951 B2 4/2010 Piepgras et al.
D618,376 S 6/2010 Redfern et al.
7,758,223 B2 7/2010 Osawa et al.
7,780,318 B2 * 8/2010 Xiao et al. ..... 362/371
D625,038 S 10/2010 Yoo
D627,502 S 11/2010 Zheng et al.
D627,911 S 11/2010 Mo et al.
7,824,075 B2 11/2010 Maxik
7,862,201 B2 1/2011 Ge et al.
7,862,214 B2 1/2011 Trott et al.
7,871,184 B2 1/2011 Peng
D633,099 S 2/2011 Van de Ven et al.
7,914,902 B2 3/2011 Kao et al.
D636,921 S 4/2011 Van de Ven et al.
D636,922 S 4/2011 Yoshida et al.
D638,160 S 5/2011 Van de Ven et al.
7,972,036 B1 7/2011 Schach et al.
7,994,725 B2 8/2011 Bouchard
8,008,845 B2 8/2011 Van de Ven
D646,011 S 9/2011 Rashidi
8,157,422 B2 4/2012 Paik et al.
8,235,555 B2 * 8/2012 Thomas et al. ..... 362/294
8,246,202 B2 8/2012 Mart et al.
8,294,356 B2 10/2012 Suwa et al.
8,434,883 B2 5/2013 Doan et al.
2002/0097095 A1 7/2002 Jeon et al.
2003/0137838 A1 7/2003 Rizkin et al.
2005/0007164 A1 1/2005 Callahan
2005/0111222 A1 * 5/2005 Olsson et al. ..... 362/267
2005/0128752 A1 * 6/2005 Ewington et al. ..... 362/294
2005/0169015 A1 * 8/2005 Luk et al. ..... 362/648
2005/0174065 A1 8/2005 Janning
2005/0242742 A1 11/2005 Cheang et al.
2005/0276053 A1 12/2005 Nortrup et al.
2006/0244396 A1 11/2006 Bucur
2006/0255753 A1 11/2006 Sawada et al.
2007/0108843 A1 5/2007 Preston et al.
2007/0137074 A1 6/2007 Van de Ven
2007/0139920 A1 6/2007 Van de Ven
2007/0139923 A1 6/2007 Negley
2007/0170447 A1 7/2007 Negley
2007/0171145 A1 7/2007 Coleman
2007/0215027 A1 9/2007 MacDonald et al.
2007/0236911 A1 10/2007 Negley
2007/0236920 A1 10/2007 Snyder
2007/0247414 A1 10/2007 Roberts
2007/0263393 A1 11/2007 Van de Ven
2007/0267983 A1 11/2007 Van de Ven
2007/0274063 A1 11/2007 Negley
2007/0274080 A1 11/2007 Negley
2007/0278503 A1 12/2007 Van de Ven
2007/0278934 A1 12/2007 Van de Ven
2007/0278974 A1 12/2007 Van de Ven
2007/0279440 A1 12/2007 Negley
2007/0279903 A1 12/2007 Negley
2007/0280624 A1 12/2007 Negley
2008/0030993 A1 2/2008 Narendran et al.
2008/0054281 A1 3/2008 Narendran et al.
2008/0084685 A1 4/2008 Van de Ven
2008/0084700 A1 4/2008 Van de Ven
2008/0084701 A1 * 4/2008 Van De Ven et al. ..... 362/373
2008/0088248 A1 4/2008 Myers
2008/0089053 A1 4/2008 Negley
2008/0089071 A1 * 4/2008 Wang ..... 362/294
2008/0094000 A1 4/2008 Yamamoto et al.
2008/0094829 A1 4/2008 Narendran et al.
2008/0105887 A1 5/2008 Narendran et al.
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0117500 A1 5/2008 Narendran et al.
2008/0128718 A1 6/2008 Sumitani

(56) References Cited

U.S. PATENT DOCUMENTS

| | | | | |
|---|---|---|---|---|
| 2008/0130285 | A1 | 6/2008 | Negley | |
| 2008/0136313 | A1 | 6/2008 | Van de Ven | |
| 2008/0137347 | A1 | 6/2008 | Trott | |
| 2008/0186704 | A1 * | 8/2008 | Chou et al. | 362/249 |
| 2008/0211415 | A1 | 9/2008 | Altamura | |
| 2008/0259589 | A1 | 10/2008 | Van de Ven | |
| 2008/0278928 | A1 | 11/2008 | Van de Ven | |
| 2008/0278940 | A1 | 11/2008 | Van de Ven | |
| 2008/0278950 | A1 | 11/2008 | Pickard et al. | |
| 2008/0278952 | A1 | 11/2008 | Trott | |
| 2008/0278957 | A1 | 11/2008 | Pickard et al. | |
| 2008/0304260 | A1 | 12/2008 | Van de Ven | |
| 2008/0304261 | A1 | 12/2008 | Van de Ven | |
| 2008/0304269 | A1 | 12/2008 | Pickard | |
| 2008/0309255 | A1 | 12/2008 | Myers | |
| 2009/0034283 | A1 | 2/2009 | Albright et al. | |
| 2009/0046464 | A1 | 2/2009 | Liu et al. | |
| 2009/0059582 | A1 | 3/2009 | Kulkarni | |
| 2009/0086474 | A1 | 4/2009 | Chou | |
| 2009/0101930 | A1 | 4/2009 | Li | |
| 2009/0108269 | A1 | 4/2009 | Negley | |
| 2009/0147517 | A1 | 6/2009 | Li et al. | |
| 2009/0160363 | A1 | 6/2009 | Negley | |
| 2009/0161356 | A1 | 6/2009 | Negley | |
| 2009/0184616 | A1 | 7/2009 | Van de Ven | |
| 2009/0184662 | A1 | 7/2009 | Given et al. | |
| 2009/0184666 | A1 | 7/2009 | Myers | |
| 2009/0196037 | A1 | 8/2009 | Xiao et al. | |
| 2009/0296384 | A1 | 12/2009 | Van de Ven et al. | |
| 2010/0014289 | A1 | 1/2010 | Thomas et al. | |
| 2010/0027258 | A1 | 2/2010 | Maxik et al. | |
| 2010/0060130 | A1 | 3/2010 | Li | |
| 2010/0060175 | A1 | 3/2010 | Lethellier | |
| 2010/0067227 | A1 | 3/2010 | Budike | |
| 2010/0079059 | A1 | 4/2010 | Roberts et al. | |
| 2010/0079262 | A1 | 4/2010 | Van Laanen | |
| 2010/0102199 | A1 | 4/2010 | Negley et al. | |
| 2010/0102697 | A1 | 4/2010 | Van de Ven | |
| 2010/0102967 | A1 | 4/2010 | Lee et al. | |
| 2010/0103678 | A1 | 4/2010 | Van de Ven et al. | |
| 2010/0109570 | A1 | 5/2010 | Weaver | |
| 2010/0135016 | A1 | 6/2010 | Ishibashi | |
| 2010/0177509 | A1 | 7/2010 | Pickard | |
| 2010/0225220 | A1 | 9/2010 | Tanaka et al. | |
| 2010/0246177 | A1 | 9/2010 | Van de Ven | |
| 2010/0246197 | A1 | 9/2010 | Takahashi et al. | |
| 2010/0308739 | A1 | 12/2010 | Shteynberg et al. | |
| 2010/0327746 | A1 | 12/2010 | Hisayasu | |
| 2011/0031894 | A1 | 2/2011 | Van de Ven | |
| 2011/0068696 | A1 | 3/2011 | Van de Ven | |
| 2011/0068702 | A1 | 3/2011 | Van de Ven | |
| 2011/0074265 | A1 | 3/2011 | Van de Ven et al. | |
| 2011/0074289 | A1 | 3/2011 | Van de Ven | |
| 2011/0075411 | A1 | 3/2011 | Van de Ven et al. | |
| 2011/0075414 | A1 | 3/2011 | Van de Ven et al. | |
| 2011/0075422 | A1 | 3/2011 | Van de Ven et al. | |
| 2011/0075423 | A1 | 3/2011 | Van de Ven | |
| 2011/0169417 | A1 | 7/2011 | Hum et al. | |
| 2011/0180818 | A1 | 7/2011 | Lerman et al. | |
| 2011/0181194 | A1 | 7/2011 | Hum et al. | |
| 2011/0198984 | A1 | 8/2011 | Van de Ven | |
| 2011/0211351 | A1 | 9/2011 | Van de Ven | |

FOREIGN PATENT DOCUMENTS

| | | | |
|---|---|---|---|
| EP | 1 881 259 | | 1/2008 |
| JP | 2009-117342 | | 5/2009 |
| WO | 2006/007388 | | 1/2006 |
| WO | 2008/036873 | | 3/2008 |
| WO | 2008/051957 | | 5/2008 |
| WO | 2008/061082 | | 5/2008 |
| WO | WO 2008051957 | A2 * | 5/2008 |
| WO | 2008/129504 | | 10/2008 |

OTHER PUBLICATIONS

"Assist Recommends . . . LED Life for General Lighting: Definition of Life", vol. 1, Issue 1, Feb. 2005.

"*Bright Tomorrow Lighting Competition* (*L prize*™)", May 28, 2008, Document No. 08NT006643.

"*Energy Star® Program Requirements for Solid State Lighting Luminaires, Eligibility Criteria*—Version 1.1", Final: Dec. 19, 2008.

Application Note: CLD-AP06.006, entitled *Cree® XLamp® XR Family* & 4550 LED Reliability, published at cree.com/xlamp, Sep. 2008.

Bulborama, Lighting Terms Reference and Glossary, http://www.bulborama.com/storelightingreferenceglossary-13.html, 6 pages.

DuPont, "*DuPont™ Diffuse Light Reflector*", Publication K-20044, May 2008, 2 pages.

Furukawa Electric Co., Ltd., Data Sheet, "*New Material for Illuminated Panels Microcellular Reflective Sheet MCPET*", updated Apr. 8, 2008, 2 pages.

Illuminating Engineering Society Standard LM-80-08, entitled "*IES Approved Method for Measuring Lumen Maintenance of LED Light Sources*", Sep. 22, 2008, ISBN No. 978-0-87995-227-3.

Kim et al., "Strongly Enhanced Phosphor Efficiency in GaInN White Light-Emitting Diodes Using Remote Phosphor Configuration and Diffuse Reflector Cup" *Japanese Journal of Applied Physics* 44(21):L649-L651 (2005).

LEDs Magazine, Press Release May 23, 2007, "*Furukawa America Debuts MCPET Reflective Sheets to Improve Clarity, Efficiency of Lighting Fixtures*", downloaded Jun. 25, 2009 from http://www.ledsmagazine.com/press/15145, 2 pages.

Philips Lumileds, Technology White Paper: "Understanding power LED lifetime analysis", downloaded from http://www.philipslumileds.com/pdfs/WP12.pdf, Document No. WP12, Last Modified May 22, 2007.

MCPET—Microcellular Reflective Sheet Properties, http://www.trocellen.com, downloaded Jun. 25, 2009, 2 pages.

U.S. Appl. No. 12/535,319, filed Aug. 4, 2009.

U.S. Appl. No. 12/411,905, filed Mar. 26, 2009.

U.S. Appl. No. 12/566,936, filed Sep. 25, 2009.

U.S. Appl. No. 12/566,850, filed Sep. 25, 2009.

U.S. Appl. No. 12/621,970, filed Nov. 19, 2009.

U.S. Appl. No. 12/566,861, filed Sep. 25, 2009.

U.S. Appl. No. 12/704,995, filed Feb. 12, 2010.

U.S. Appl. No. 12/566,142, filed Sep. 24, 2009.

U.S. Appl. No. 12/566,195, filed Sep. 24, 2009.

U.S. Appl. No. 29/344,218, filed Sep. 25, 2009, Van de Ven.

Chinese Office Action dated Sep. 26, 2013 (and translation provided by foreign counsel), 10 pages.

U.S. Appl. No. 29/403,280, filed Oct. 4, 2011, Van de Ven et al.

* cited by examiner

LIGHT ENGINES FOR LIGHTING DEVICES

FIELD OF THE INVENTIVE SUBJECT MATTER

The present inventive subject matter is directed to light engines. In some aspects, the present inventive subject matter is directed to light engines that comprise one or more solid state light emitters, e.g., one or more light emitting diodes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs generally have lifetimes (e.g., 10,000-20,000 hours) that are longer than those of incandescent lights, but they typically provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

There are a number of challenges presented with using light emitting diodes in lighting devices. In many cases, additional components are added to the lighting devices in order to address these challenges. It would be desirable to provide a light engine that comprises one or more solid state light emitters, in which such challenges are addressed and yet the light engine (or lighting device that includes the light engine) can fit within the same or substantially the same space that is provided for comparable conventional lighting devices (e.g., lighting devices that include one or more incandescent light sources and/or one or more fluorescent light sources). The ability for the light engine (or lighting device that includes the light engine) to fit in a space that is similar to (or identical to) a space into which conventional devices can fit is important when retro-fitting a lighting device, as well when installing a light engine (or lighting device that includes the light engine) in new construction.

One such challenge results from the fact that the emission spectrum of any particular light emitting diode is typically concentrated around a single wavelength (as dictated by the light emitting diode's composition and structure), which is desirable for some applications, but not desirable for others, (e.g., for providing general illumination, such an emission spectrum generally does not provide light that appears white, and/or provides a very low CRI). As a result, in many cases (e.g., to make devices that emit light perceived as white or near-white, or to make devices that emit light that is not highly saturated) it is necessary to employ light sources (e.g., one or more solid state light emitters and optionally also one or more other types of light sources, e.g., additional light emitting diodes, luminescent materials, incandescent lights, etc.) that emit light of different colors. There are a variety of reasons that one or more solid state light emitters might cease emitting light and/or vary in their intensity of light emission, which can throw off the balance of color output and cause the lighting device to emit light that is perceived as being of a color that differs from the desired color of light output. As a result, in many of such devices, one challenge that necessitates the inclusion of additional components is that there may be a desire to provide additional circuitry that can adjust the current supplied to respective solid state light emitters (and/or other light emitters) in order to maintain the balance of color output among the light emitters that emit light of different colors in order to achieve the desired color output. Another such challenge is that there may be a desire to mix the light of different colors emitted from the different solid state light emitters by providing additional structure to assist in such mixing.

One example of a reason that one or more solid state light emitters might vary in their intensity of light emission is temperature change (resulting, e.g., from change in ambient temperature and/or heating up of the solid state light emitters). Some types of solid state light emitters (e.g., solid state light emitters that emit light of different colors) experience differences in intensity of light emission (if supplied with the same current) at different temperatures, and frequently such changes in intensity occur to differing extents for emitters that emit light of different colors as temperature changes. For example, some light emitting diodes that emit red light have a very strong temperature dependence in at least some temperature ranges (e.g., AlInGaP light emitting diodes can reduce in optical output by ~20% when heated up by ~40 degrees C., that is, approximately −0.5% per degree C.; some blue light emitting InGaN+YAG:Ce light emitting diodes can reduce in optical output by about −0.15%/degree C.).

Another example of a reason that one or more solid state light emitters might vary in their intensity of light emission is aging. Some solid state light emitters (e.g., solid state light emitters that emit light of different colors) experience decreases in intensity of light emission (if supplied with the same current) as they age, and frequently such decreases in intensity occur at differing rates.

Another example of a reason that one or more solid state light emitters might vary in their intensity of light emission is damage to the solid state light emitter(s) and/or damage to circuitry that supplies current to the solid state light emitter(s).

Another challenge presented in making a lighting device with light emitting diodes, that often necessitates the inclusion of additional components, is that the performance of many solid state light emitters may be reduced when they are subjected to elevated temperatures. For example, many light emitting diode light sources have average operating lifetimes of decades as opposed to just months or 1-2 years for many incandescent bulbs, but some light emitting diodes' lifetimes can be significantly shortened if they are operated at elevated temperatures. A common manufacturer recommendation is that the junction temperature of a light emitting diode should not exceed 85 degrees C. if a long lifetime is desired. There may be a desire to counteract such problems, in many instances, by providing additional structure (or structures) to provide a desired degree of heat dissipation.

Another challenge presented in making a lighting device with light emitting diodes, that often necessitates the inclusion of additional components, arises from the relatively high light output from a relatively small area provided by solid state emitters. Such a concentration of light output may present challenges in providing solid state lighting systems for general illumination in that, in general, a large difference in brightness in a small area may be perceived as glare and may be distracting to occupants. In many instances, therefore, there is a desire to provide additional structure to assist in mixing the emitted light and/or creating the perception that the emitted light is output through a larger area.

Another challenge presented in making a lighting device with light emitting diodes, that often necessitates the inclusion of additional components, is that light emitting diodes are typically run most effectively on low voltage DC current, while line voltage is typically much higher voltage AC current. As a result, there is often a desire to provide circuitry that converts line voltage, e.g., from AC to DC and/or that reduces voltage.

In addition, in some circumstances, there is a desire either to retrofit or install a lighting device in a circuit that has a conventional dimmer. Some dimmers operate based on signals contained in the current supplied to the lighting device (for example, duty cycle of an AC signal, e.g., from a triac), for which additional circuitry is generally needed.

It would be desirable to be able to make a variety of lighting devices that include different numbers of solid state light emitters, and thereby generate heat at a variety of different rates, and to make it possible to easily provide heat dissipation systems that are suited to each of such a variety of lighting devices. It would be desirable to provide lighting devices in which the amount of heat that can be dissipated can be selected to match the rate of heat generation by each individual lighting device. For example, persons of skill in the art can readily envision a series of lighting devices in which each member of the series has a different number of light emitting diodes, resulting in respective different rates of heat generation. It would be desirable to be able to provide device by which incrementally different rates of heat dissipation in such respective devices could be interchangeably provided.

There exist conventional lighting devices that have a wide variety of trim structures and/or fixture element structures. It would be desirable to be able to easily make a variety of solid state light emitter lighting devices (i.e., lighting devices that comprise one or more solid state light emitters) that include different types of trim structures and/or housing structures.

There exist conventional lighting devices that have light intensity outputs and/or power inputs that would require a wide variety of circuitry in order to provide equivalent output from a lighting device comprising one or more solid state light emitters, and it would be desirable to be able to easily make a variety of solid state light emitter lighting devices that can provide such light intensity outputs and/or that can be powered by such power inputs.

BRIEF SUMMARY OF THE INVENTIVE SUBJECT MATTER

In some aspects, the present inventive subject matter provides light engines (and lighting devices that comprise such light engines) that can provide such features.

In accordance with one aspect of the present inventive subject matter, there are provided light engines for lighting devices, in which the light engines can readily be interchangeably combined with one or more of a wide variety of heat sink modules, one or more of a wide variety of power supply modules, and/or one or more of a wide variety of driver modules that allow for adjustability depending on the desired application for the lighting device.

In accordance with another aspect of the present inventive subject matter, there are provided light engines that each comprise a light engine housing, and a modular mixing chamber element (i.e., a mixing chamber module) and/or a modular driver chamber element (i.e., a driver chamber module), whereby the light engine housing can readily be interchangeably combined with one or more of a wide variety of mixing chamber elements, and/or one or more of a wide variety of driver chamber elements, in order to provide a lighting device or light engine that can accommodate the components needed for the lighting device (or a lighting device that includes the light engine) to satisfy the needs for a particular application (or in order to provide the components needed).

In accordance with another aspect of the present inventive subject matter, there are provided light engines that each comprise a light engine housing, and a mixing chamber element that is removably attached to the light engine housing and/or a driver chamber element that is removably attached to the light engine housing. By providing a mixing chamber element that is removable and/or a driver chamber element that is removable, one or more of a wide variety of mixing chamber elements, and/or one or more of a wide variety of driver chamber elements can readily be interchanged (i.e., can be selectively combined with the light engine or the lighting device) in order to accommodate the components needed for a particular application (or in order to provide the components needed for such application).

In some embodiments according to the present inventive subject matter, there are provided light engines for lighting devices, in which the light engines can readily be interchangeably combined with one or more trim elements and/or one or more fixture elements (and optionally also one or more heat sink modules, one or more power supply modules, and/or one or more driver modules, as mentioned above).

In one aspect of the present inventive subject matter, there is provided a light engine comprising a light engine housing that comprises at least a first connection element. In some embodiments, the light engine housing further comprises a mixing chamber element and/or a driver chamber element. In some embodiments in which the light engine housing further comprises a mixing chamber element, the mixing chamber element at least in part defining a mixing chamber. In some embodiments, the connection element provides both mechanical connection and thermal coupling between the light engine housing and at least one other component, e.g., a mixing chamber element, a driver chamber element, a fixture housing, a trim element and/or a heat sink module.

In another aspect of the present inventive subject matter, there is provided a light engine comprising a light engine housing to which a variety of mixing chamber elements can be interchangeably connected and/or to which a variety of driver chamber elements can be interchangeably connected (and/or in which a variety of mixing chamber elements can be interchangeably positioned and/or in which a variety of driver chamber elements can be interchangeably positioned).

In another aspect of the present inventive subject matter, there is provided a light engine comprising a light engine housing and at least one light source (e.g., a solid state light emitter), the light engine housing comprising a mixing chamber element, a driver chamber element and at least a first connection element, and the mixing chamber element at least in part defining a mixing chamber in which light from the at least one light source mixes prior to exiting the light engine housing.

In some embodiments according to the present inventive subject matter, which can include or not include any of the features described herein, there is provided a lighting device that comprises a light engine as described herein, and the lighting device can further comprise at least one fixture element, at least one trim element, and/or at least one heat sink module. In some of such embodiments, the fixture element(s), the trim element(s), and/or the heat sink module(s), or any combination thereof, is/are attached to a connection element or to respective connection elements.

In some embodiments according to the present inventive subject matter, which can include or not include any of the features described herein, the first connection element has at least first and second apertures, the first aperture has an axis that extends in a first direction, and the second aperture has an axis that extends in a second direction, the first direction differing from the second direction. In some of such embodiments, at least one of the axis of the first aperture and the axis of the second apertures is substantially parallel to an axis of the light engine housing, and/or at least one of the axis of the first aperture and the axis of the second apertures is substantially perpendicular to an axis of the light engine housing.

In some embodiments according to the present inventive subject matter, which can include or not include any of the features described herein, the first connection element has at least first and second mounting surfaces, and the first mounting surface and the second mounting surface are not parallel. In some of such embodiments:

at least one of the first and second mounting surfaces defines a plane with respect to which an axis of the light engine housing is substantially parallel, at least one of the first and second mounting surfaces defines a plane that is substantially perpendicular to an axis of the light engine housing, and/or at least a first aperture is formed in the first mounting surface and at least a second aperture is formed in the second mounting surface, the first aperture having an axis that extends in a first direction, the second aperture having an axis that extends in a second direction, the first direction differing from the second direction.

In some embodiments according to the present inventive subject matter, which can include or not include any of the features described herein, there is provided a lighting device that comprises a light engine as described herein, and the lighting device can further comprise at least one component selected from among driver components and power supply components. In some of such embodiments, the at least one component selected from among driver components and power supply components is/are positioned within the driver chamber element.

In some embodiments according to the present inventive subject matter, which can include or not include any of the features described herein, there is provided a lighting device that comprises a light engine as described herein, and the lighting device can further comprise at least one electrical connector.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 2:
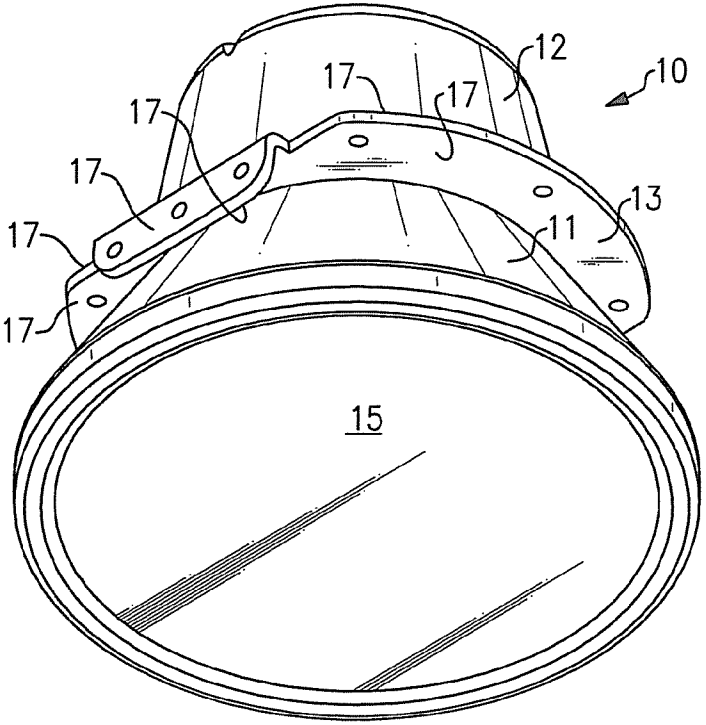
FIG. 2 is a second perspective view of the light engine 10.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some electromagnetic radiation (e.g., visible light). The expression "illuminated" encompasses situations where the solid state light emitter emits electromagnetic radiation continuously, or intermittently at a rate such that a human eye would perceive it as emitting electromagnetic radiation continuously or intermittently, or where a plurality of solid state light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "the first direction differing from the second direction", e.g., as used in the expression "the first aperture having an axis that extends in a first direction, the second aperture having an axis that extends in a second direction, the first direction differing from the second direction" means that an axis of the first aperture and an axis of the second aperture are not identical or parallel.

The expression "axis of the aperture" (and the like), as used herein, can refer to a straight line about which the aperture is substantially symmetrical. In instances where the aperture is not substantially symmetrical about any line, the expression "axis of the aperture" can refer to a line about which rotation of a uniform-density object that fills the aperture would be substantially balanced.

The expression "substantially symmetrical", as used herein, when referring to a shape, means that the shape is symmetrical or could be made symmetrical by removing a specific region or regions which in total comprise not more than about 10 percent of its volume and/or by adding a specific region or regions which in total comprise not more than about 10 percent of its volume.

The expression "substantially balanced", as used herein, when referring to a structure, means that the structure is balanced or could be balanced by adding to a specific location or locations mass that in total comprises not more than about 10 percent of the mass of the structure.

The expression "the first mounting surface and the second mounting surface not being parallel", e.g., as used in the expression "the connection element having at least first and second mounting surfaces, the first mounting surface and the second mounting surface not being parallel" means that a first plane defined by the first mounting surface and a second plane defined by the second mounting surface are not parallel or substantially parallel (i.e., that the respective first and second planes do not diverge from each other by more than an angle of 5 degrees.

The expression "first plane defined by the first mounting surface", means a plane in which at least 90% of the points in the first mounting surface are located on the plane or between the plane and a second plane that is spaced from the plane by a distance of not more than 5% of the largest dimension of the surface, and likewise for other similar expressions.

The expression "substantially parallel" means that two lines (or two planes) do not diverge from each other by more than an angle of 5 degrees.

The expression "substantially perpendicular", as used herein, means that at least 90% of the points in the structure which is characterized as being substantially perpendicular to a reference plane or line are located on one of or between a pair of planes (1) which are perpendicular to the reference plane, (2) which are parallel to each other and (3) which are spaced from each other by a distance of not more than 5% of the largest dimension of the structure.

The expression "thermal coupling", as used herein, means that heat transfer occurs between (or among) the two (or more) items for which there is thermal coupling. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermal coupling" encompasses structures that are "adjacent" (as defined herein) to one another. In some situations/embodiments, the majority of the heat transferred from the light source is transferred by conduction; in other situations/embodiments, the majority of the heat that is transferred from the light source is transferred by convection; and in some situations/embodiments, the majority of the heat that is transferred from the light source is transferred by a combination of conduction and convection.

The expression "adjacent", as used herein to refer to a spatial relationship between a first structure and a second structure, means that the first and second structures are next to each other. That is, where the structures that are described as being "adjacent" to one another are similar, no other similar structure is positioned between the first structure and the second structure (for example, where two dissipation elements are adjacent to each other, no other dissipation element is positioned between them). Where the structures that are described as being "adjacent" to one another are not similar, no other structure is positioned between them.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one light engine according to the present inventive subject matter, wherein the light engine illuminates at least a portion of the enclosed space (uniformly or non-uniformly).

Some embodiments of the present inventive subject matter comprise at least a first power line, and some embodiments of the present inventive subject matter are directed to a structure comprising a surface and at least one light engine corresponding to any embodiment of a light engine according to the present inventive subject matter as described herein, wherein if current is supplied to the first power line, and/or if at least one solid state light emitter in the light engine is illuminated, the light engine would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one light engine as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in some aspects, the present inventive subject matter is directed to a light engine that comprises a light engine housing and at least one solid state light emitter, in which the light engine housing comprises at least one connection element, and in some embodiments, the light engine housing further comprises a mixing chamber element and/or a driver chamber element.

Some or all of the one or more solid state light emitters can be provided in the light engine housing, e.g., in a mixing chamber element and/or in a driver chamber element.

Persons of skill in the art are familiar with, and have ready access to, a wide variety of solid state light emitters, and any suitable solid state light emitter (or solid state light emitters) can be employed in the light engines according to the present inventive subject matter. A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Light engines according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters (and optionally one or more luminescent materials) can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22. 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Yen and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. Pat. application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

In general, light of any number of colors can be mixed by the light engines according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley; attorney docket no. 931_081 PRO), the entirety of which is hereby incorporated by reference as if set forth in its entirety; and U.S. patent application Ser. No. 12/535,319, filed on Aug. 4, 2009 (now U.S. Patent Publication No. 2011/0031894), the entirety of which is hereby incorporated by reference as if set forth in its entirety.

A mixing chamber element (if included) can be of any suitable shape and size, and can be made of any suitable material or materials. Light emitted by the one or more solid state light emitters can be mixed to a suitable extent in a mixing chamber before exiting the light engine. Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments, a mixing chamber element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments, a mixing chamber is defined (at least in part) by a mixing chamber element. In some embodiments, a mixing chamber is defined in part by a mixing chamber element (and/or by a trim element) and in part by a lens and/or a diffuser. The expression "defined (at least in part)", e.g., as used in the expression "mixing chamber is defined (at least in part) by a mixing chamber element" means that the element or feature that is defined "at least in part" by a particular structure is defined completely by that structure or is defined by that structure in combination with one or more additional structures.

A driver chamber element (if included) can be of any suitable shape and size, and can be made of any suitable material or materials. In some embodiments, a driver chamber element (or at least a part thereof) can be made of the same material or materials as a mixing chamber element (or a portion thereof), and/or a driver chamber element (or at least a part thereof, e.g., a cover) can be made of plastic, glass, metal (optionally with one or more insulator), or a flame resistant fiber material. In some embodiments, a driver chamber element and a mixing chamber element are integral.

In some embodiments, a driver chamber element is shaped so that it can accommodate any of a variety of driver modules and/or power supply modules (or one or more components thereof) involved in receiving current supplied to a lighting device, modifying the current (e.g., converting it from AC to DC and/or from one voltage to another voltage), and/or driving one or more solid state light emitters (e.g., illuminating one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power, such as a dimming signal in AC power supplied to the lighting device), e.g., any of the components discussed herein.

In some embodiments according to the present inventive subject matter, there is provided a light engine in which one or more components are provided in a driver chamber element, as desired and/or as suitable. For example, a driver module (or at least a portion of a driver module) can be provided in a driver chamber element. A driver module can comprise any of (1) an electrical connector, for example, one or more wires (e.g., that can be connected to one or more wire-receiving elements or spliced to other wires), an Edison plug or GU24 pins, (2) one or more electrical components employed in converting electrical power (e.g., from AC to DC and/or from one voltage to another voltage), (3) one or more electrical components employed in driving one or more solid state light emitter, e.g., running one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power (e.g., a dimming signal in AC power supplied to the lighting device), etc., (4) one or more circuit boards (e.g., a metal core circuit board) for supporting and/or providing current to any electrical components, (5) one or more wires connecting any components (e.g., connecting an Edison plug to a circuit board), etc.

Different driver modules and/or power supply modules can be provided that include any of such components selected and/or combined to be suitable to connect to any given power input and to drive any solid state light emitter or combination of solid state light emitters connected to each other in any way, and to drive the solid state light emitter or solid state light emitters in any suitable way.

Any desired circuitry (including any desired electronic components) can be employed in order to supply energy to the one or more solid state light emitters according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

U.S. Patent Application No. 12/566,142, filed on Sep. 24, 2009, entitled "Solid State Lighting Apparatus With Configurable Shunts" (now U.S. Patent Publication No. (now U.S. Patent Publication No. 2011-0068696, the entirety of which is hereby incorporated by reference as if set forth in its entirety;

U.S. Patent Application Ser. No. 12/566,195, filed on Sep. 24, 2009, entitled "Solid State Lighting Apparatus With Controllable Bypass Circuits And Methods Of Operation Thereof', now U.S. Patent Publication No. (now U.S. Patent Publication No. 2011-0068702), the entirety of which is hereby incorporated by reference as if set forth in its entirety.

For example, solid state lighting systems have been developed that include a power supply that receives the AC line voltage and converts that voltage to a voltage (e.g., to DC and to a different voltage value) and/or current suitable for driving solid state light emitters. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In some embodiments according to the present inventive subject matter, there is provided a light engine in which one or more components as discussed herein (e.g., one or more electrical components involved in receiving current supplied to a lighting device, modifying the current, and/or driving one or more solid state light emitters) is/are provided in a mixing chamber element, and/or in which one or more of such components is/are provided partially in a mixing chamber element and partially in a driver chamber element. In some embodiments of lighting devices that include light engines according to the present inventive subject matter, a power supply can be provided elsewhere, i.e., not in the light engine.

In some embodiments of light engines according to the present inventive subject matter, some components of a power supply can be provided in a driver chamber element, and other components of a power supply can be provided in a mixing chamber element.

Various electronic components in the light engine can be mounted in any suitable way. For example, in some embodiments, light emitting diodes can be mounted on a first circuit board (a "light emitting diode circuit board") and electronic circuitry that can convert AC line voltage into DC voltage suitable for being supplied to light emitting diodes can be mounted on a second circuit board (a "driver circuit board"), whereby line voltage is supplied to the electrical connector and passed along to the driver circuit board, the line voltage is converted to DC voltage suitable for being supplied to light emitting diodes in the driver circuit board, and the DC voltage is passed along to the light emitting diode circuit board where it is then supplied to the light emitting diodes. In some embodiments according to the present inventive subject matter, the light emitting diode circuit board is a metal core circuit board.

The at least one connection element can be of any suitable shape and size, and can be made of any suitable material or materials. In some embodiments, the connection element is made of the same material or materials as a mixing chamber element (or a portion thereof) and/or a driver chamber element (or a portion thereof). In some embodiments, the connection element can be integral with a driver chamber element and/or a mixing chamber element. All connection element features can be provided in a single connection element, or one or more features can be provided in each of two or more connection elements or connection element regions.

The connection element is provided to enable one or more heat sink modules, one or more power supply modules, one or more driver modules, one or more trim elements and/or one or more fixture elements to be easily attached to the light engine.

In some embodiments, the connection element (or at least one of the connection elements) has one or more apertures and/or one or more mounting surfaces which can be used in connecting the one or more heat sink modules, the one or more power supply modules, the one or more driver modules, the one or more trim elements and/or the one or more fixture elements to be easily attached to the light engine.

In some embodiments, the connection element (or at least one of the connection elements) can be positioned (and/or clamped) between the mixing chamber element and the driver chamber element. For example, in some embodiments, the mixing chamber element and the driver chamber element can be connected to each other (for example using screws and/or bolts extending through at least a portion of the mixing chamber element and at least a portion of the driver chamber element), with the connection element (or one or more of the connection elements) clamped between the mixing chamber element and the driver chamber element.

In some embodiments, the connection element (or at least one of the connection elements) can be integral with the mixing chamber element and/or with the driver chamber element.

The at least one heat sink module (when included) can be of any of a wide variety of shapes and sizes.

In some embodiments, the light engine comprises one or more removable heat sink modules. The expression "removable", as used herein when referring to one or more heat sink modules, means that the heat sink module (or modules) can be removed from the light engine without severing any material, e.g., by loosening and/or removing one or more screws or bolts and removing the heat sink module (or modules) from the light engine.

In some embodiments, including some embodiments that include or do not include any of the features described above, one or more heat sink modules (which may be removable) can be selected and attached to the light engine so as to provide a desired rate of heat dissipation capability under specific circumstances (e.g., when all of the light sources in the light engine are fully illuminated and after thermal equilibrium has been reached, and under typical air flow conditions), based on the heat generation characteristics of the one or more light sources that are provided in (or that will be provided in) the light engine.

The expression "after thermal equilibrium has been reached" refers to supplying current to one or more light sources in a light engine to allow the light source(s) and other surrounding structures to heat up to (or near to) a temperature to which they will typically be heated when the light engine is illuminated. The particular duration that current should be supplied will depend on the particular configuration of the light engine. For example, the greater the thermal mass, the longer it will take for the light source(s) to approach their thermal equilibrium operating temperature. While a specific time for operating the light engine prior to reaching thermal equilibrium may be light engine specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) without a change in ambient or operating conditions.

A heat sink module (and any additional heat sink modules), if included, can be made from any suitable material or combination of materials, a wide variety of which will be apparent to persons skilled in the art. In light engines that comprise more than one heat sink module, any of the different heat sink modules can be made of differing materials or combinations of materials.

Representative examples of materials that can be employed in making heat sink modules include, for example, materials that inherently have high thermal conductivities, such as metals, metal alloys, ceramics, and polymers mixed with ceramic or metal or metalloid particles. One of the more common materials is aluminum.

The at least one heat sink module (when included) can be any suitable module (or modules). Representative examples of structures that can be used as heat sink modules in accordance with the present inventive subject matter are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety; and U.S. patent application Ser. No. 12/566.850, filed on Sep. 25, 2009, entitled "Lighting Device With One Or More Removable Heat Sink Elements" (now U.S. Patent Publication No. 2011/0074265), the entirety of which is hereby incorporated by reference as if set forth in its entirety.

Light engines according to the present inventive subject matter can comprise one or more electrical connectors, and/or lighting devices that comprise light engines according to the present inventive subject matter can comprise one or more electrical connectors.

Various types of electrical connectors are well known to those skilled in the art, and any of such electrical connectors can be attached within (or attached to) the light engines according to the present inventive subject matter. Representative examples of suitable types of electrical connectors include wires (for splicing to a branch circuit), Edison plugs (which are receivable in Edison sockets) and GU24 pins (which are receivable in GU24 sockets).

An electrical connector, when included, can be electrically connected to the one or more solid state light emitters (or to at least one of the one or more solid state light emitters) in any suitable way. A representative example of a way to electrically connect a solid state light emitter to an electrical connector is to connect a first portion of a flexible wire to the electrical connector and to connect a second portion of the flexible wire to a circuit board (e.g., a metal core circuit board) on which the solid state light emitter (or a plurality of solid state light emitters) is mounted.

Some embodiments in accordance with the present inventive subject matter can comprise a power line that can be connected to a source of power (such as a branch circuit, a battery, a photovoltaic collector, etc.) and that can supply power to an electrical connector (or directly to the light engine, e.g., the power line itself can be an electrical connector). Persons of skill in the art are familiar with, and have ready access to, a variety of structures that can be used as a power line. A power line can be any structure that can carry electrical energy and supply it to an electrical connector on a lighting device and/or to a light engine according to the present inventive subject matter.

Energy can be supplied to the lighting devices according to the present inventive subject matter from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

In some embodiments, at least one trim element can be attached to the light engine according to the present inventive subject matter. A trim element (if included) can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®.

In some embodiments according to the present inventive subject matter, a mixing chamber element can be provided which comprises a trim element (e.g., a single structure can be provided which acts as a mixing chamber element and as a trim element, a mixing chamber element can be integral with a trim element, and/or a mixing chamber element can comprise a region that functions as a trim element). In some embodiments, such structure can also comprise some or all of a thermal management system for the lighting device. By providing such a structure, it is possible to reduce or minimize the thermal interfaces between the solid state light emitter(s) and the ambient environment (and thereby improve heat transfer), especially, in some cases, in devices in which a trim element acts as a heat sink for light source(s) (e.g., solid state light emitters) and is exposed to a room. In addition, such a structure can eliminate one or more assembly steps, and/or reduce parts count. In such light engines, the structure (i.e., the combined mixing chamber element and trim element) can further comprise one or more reflector and/or reflective film, with the structural aspects of the mixing chamber element being provided by the combined mixing chamber element and trim element).

In some embodiments, at least one fixture element can be attached to the light engine according to the present inventive subject matter. A fixture element, when included, can comprise a housing, a mounting structure, and/or an enclosing structure. Persons of skill in the art are familiar with, and can envision, a wide variety of materials out of which a fixture element, a housing, a mounting structure and/or an enclosing structure can be constructed, and a wide variety of shapes for such a fixture element, a housing, a mounting structure and/or an enclosing structure. A fixture element, a housing, a mounting structure and/or an enclosing structure made of any of such materials and having any of such shapes can be employed in accordance with the present inventive subject matter.

For example, fixture elements, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety; and U.S. patent application Ser. No. 12/469,828, filed on May 21, 2009 (now U.S. Patent Publication No. 2010/0103678), the entirety of which is hereby incorporated by reference as if set forth in its entirety.

In some embodiments, a fixture element, if provided, can further comprise an electrical connector that engages an electrical connector on the light engine or that is electrically connected to the light engine In some embodiments that include a fixture element, an electrical connector is provided that is substantially non-moving relative to the fixture element, e.g., the force normally employed when installing an Edison plug in an Edison socket does not cause the Edison socket to move more than one centimeter relative to the housing, and in some embodiments, not more than ½ centimeter (or not more than ¼ centimeter, or not more than one millimeter, etc.). In some embodiments, an electrical connector that engages an electrical connector on the light engine can move relative to a fixture element, and structure can be provided to limit movement of the light engine relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, one or more structures can be attached to a light engine that engage structure in a fixture element to hold the light engine in place relative to the fixture element. In some embodiments, the light engine can be biased against a fixture element, e.g., so that a flange portion of a trim element is maintained in contact (and forced against) a bottom region of a fixture element (e.g., a circular extremity of a cylindrical can light housing). For example, some embodiments include one or more spring retainer clips (sometimes referred to as "chicken claws") which comprise at least first and second spring-loaded arms (attached to the light engine or to a trim element that is attached to the light engine) and at least one engagement element (attached to a fixture element), the first and second spring loaded arms being spring biased apart from each other (or toward each other) into contact with opposite sides of the engagement element, creating friction which holds the light engine in position relative to the fixture element, while permitting the light engine to be moved to different positions relative to the fixture element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can have a hook at a remote location, which can prevent the light engine from being moved away from the fixture element beyond a desired extreme location (e.g., to prevent the light engine from falling out of the fixture element).

As noted above, additional examples of structures that can be used to hold a light engine in place relative to a fixture element are disclosed in U.S. patent application Ser. No. 11/877,038, filed Oct. 23, 2007 (now U.S. Patent Publication No. 2008/0106907), the entirety of which is hereby incorporated by reference as if set forth in its entirety).

Another example of a structure that can be used to hold a light engine in place relative to a fixture element is a telescoping element, i.e., an element that has at least first and second sections that telescope relative to each other, the light engine (or a trim element attached to the light engine) being connected to the first section, the second section being connected to the fixture element.

Another example of a structure that can be used to hold a light engine in place relative to a fixture element is an axial spring, where the light engine (or a trim element attached to the light engine) is connected to a first region of the axial spring and a second region of the axial spring is connected to the fixture element. In some embodiments, the light engine (or a trim element attached to the light engine) can be attached (via an axial spring) to a first region of the fixture element, and the light engine (or a trim element attached to the light engine) can be biased by the axial spring into engagement with a second region of the fixture element (e.g., a circular lower-most edge of a cylindrical can) or with a construction element to which the fixture element is attached (e.g., a lower flange of a trim element attached to the light engine can be biased by the axial spring upward into engagement with a ceiling in which the fixture element is mounted).

Another example of a structure that can be used to hold a light engine in place relative to a fixture element is a ratcheting element in which a ratcheting portion can be pushed in a first direction relative to a ratcheting receptacle but not in an opposite direction, the light engine (or a trim element attached to the light engine) is connected to one of the ratcheting portion and the ratcheting receptacle, and the fixture element is connected to the other of the ratcheting portion and the ratcheting receptacle, whereby the light engine (or a trim element attached to the light engine) can be incrementally moved in one direction (but not the other direction) relative to the fixture element.

Another example of a structure that can be used to hold a light engine in place relative to a fixture element is a retracting reel, in which a reel is spring biased to rotate in a direction in which it would wind up a cable, one of the light engine (or a trim element attached to the light engine) and the fixture element is connected to the reel and the cable is connected to the other of the light engine (or a trim element attached to the light engine) and the fixture element, whereby the structure connected to the cable can be moved away from the other structure by a force which causes the cable to wind out of the reel, and the spring bias of the reel biases the light engine (or a trim element attached to the light engine) and the fixture element toward each other (for instance, a trim element attached to the light engine can be biased by the reel upward into engagement with a ceiling in which the fixture element is mounted).

Some embodiments in accordance with the present inventive subject matter can include one or more lenses or diffusers. Persons of skill in the art are familiar with a wide variety of lenses and diffusers, can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

One or more scattering elements (e.g., layers) can optionally be included in the light engines (or lighting devices) according to the present inventive subject matter. A scattering element can be included in a lumiphor, and/or a separate scattering element can be provided. A wide variety of separate scattering elements and combined luminescent and scattering elements are well known to those of skill in the art, and any such elements can be employed in the light engines of the present inventive subject matter.

In many situations, the lifetime of solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the light engine is/are selected so as to extract heat from the solid state light emitters) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any heat sink module (if included) (or other module, element, modules or elements) can comprise one or more thermal transfer region(s) that has/have an elevated heat conductivity (e.g., higher than the rest of that heat sink module or other element or module). A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

The lighting devices according to the present inventive subject matter can further comprise elements that help to ensure that the perceived color (including color temperature) of the light exiting the light engine (or a mixing chamber element attached to the light engine) is accurate (e.g., within a specific tolerance). A wide variety of such elements and combinations of elements are known, and any of them can be employed in the light engines according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety; and U.S. patent application Ser. No. 12/469,819, filed on May 21, 2009 (now U.S. Patent Publication No. 2010/0102199), the entirety of which is hereby incorporated by reference as if set forth in its entirety.

The light engines of the present inventive subject matter can be arranged in generally any suitable orientation, a variety of which are well known to persons skilled in the art. For example, the lighting device can be a back-reflecting device or a front-emitting device.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 1:
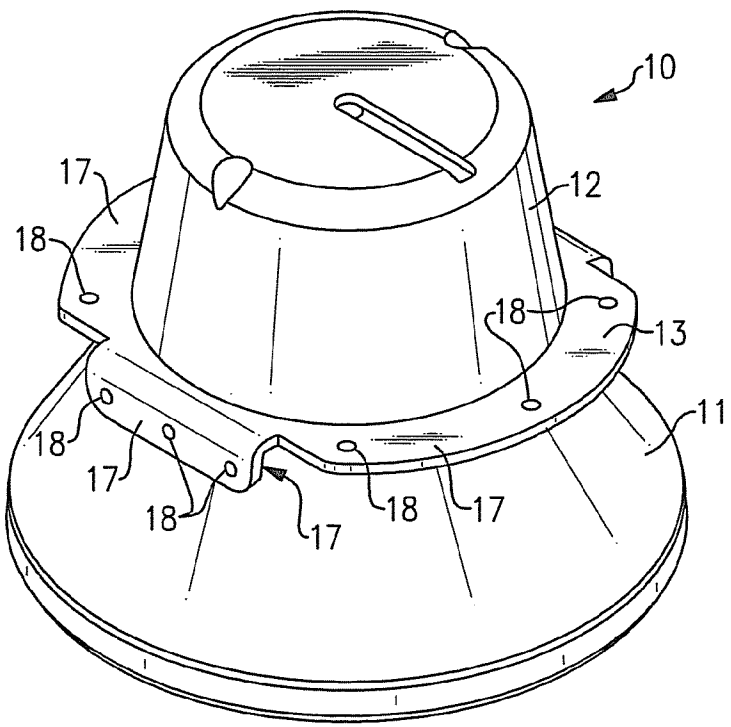
FIG. 1 is a first perspective view of a light engine 10.
Figure 3:
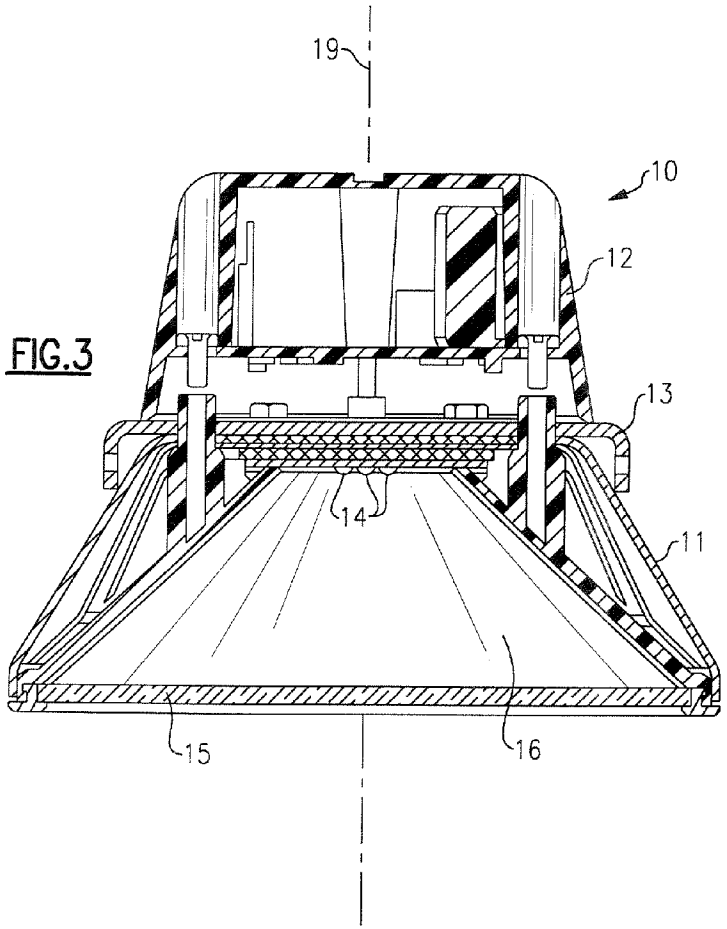
FIG. 3 is a sectional view of the light engine 10.

FIGS. 1-3 illustrate a light engine 10 in accordance with the present inventive subject matter. FIG. 1 is a first perspective view of the light engine 10. FIG. 2 is a second perspective view of the light engine 10. FIG. 3 is a sectional view of the light engine 10.

Referring to FIG. 1, the light engine 10 comprises a light engine housing that comprises a mixing chamber element 11, a driver chamber element 12 and a connection element 13. Any of these elements (i.e., the mixing chamber element 11, the driver chamber element 12 and the connection element 13) can be provided in two or more pieces if desired, rather than as a unitary structure.

The light engine 10 also comprises a plurality of light emitting diodes 14 (see FIG. 3) The light emitting diodes 14 can include a plurality of light emitting diodes that emit blue light (at least some of which are packaged with luminescent material that emits greenish-yellowish light) and a plurality of light emitting diodes that emit red light.

The light engine 10 also comprises a lens 15.

The mixing chamber element 11 defines a mixing chamber 16 in which light emitted by the light emitting diodes 14 mixes prior to exiting the light engine housing 10.

The connection element 13 has a plurality of mounting surfaces 17 (see FIGS. 1 and 2), e.g., top and bottom surfaces and front and back surfaces, any or all of which can be used to connect to other modules or elements. As can be seen in FIGS. 1 and 2, there are many pairs of mounting surfaces 17 that are not parallel to one another. The connection element 13 also has a plurality of apertures 18 that have respective axes, some of which extend in directions that differ from the directions in which the axes of other apertures 18 extend, some of which are substantially parallel to or perpendicular to the axis 19 of the light engine housing 10.

Figure 4:
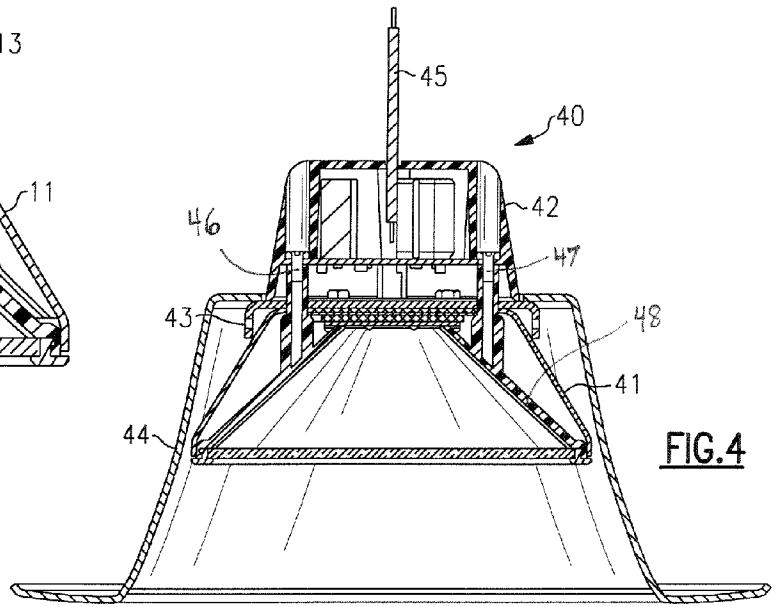
FIG. 4 is a sectional view of a downlight 40.
Figure 6:
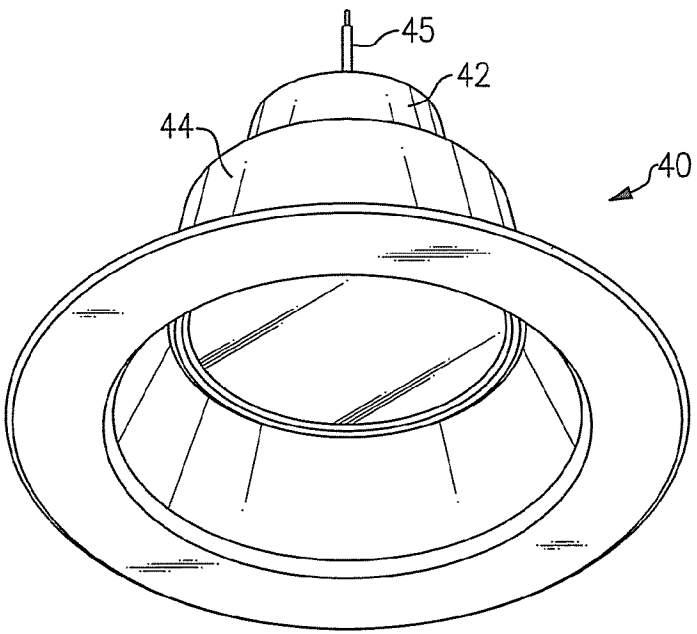
FIG. 6 is a second perspective view of the downlight 40.
Figure 5:
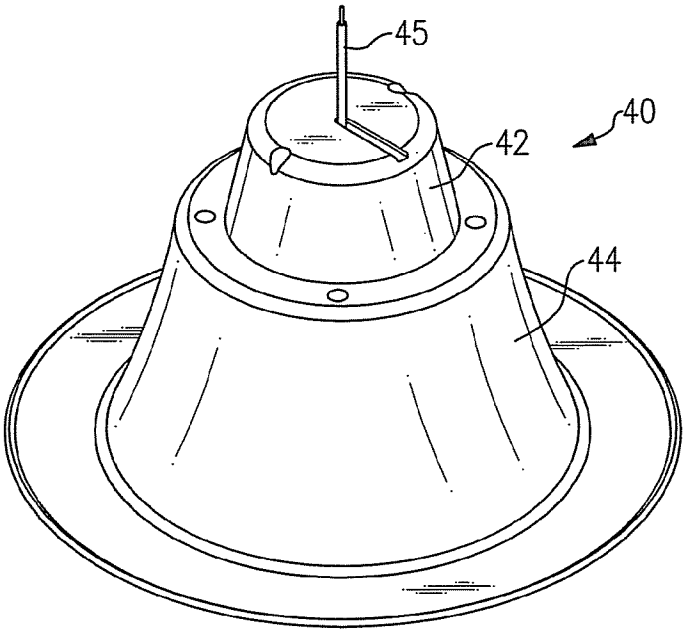
FIG. 5 is a first perspective view of the downlight 40.

FIGS. 4-6 illustrate a downlight 40 in accordance with the present inventive subject matter, for use in, e.g., a ceiling recessed downlight with spinning trim. FIG. 4 is a sectional view of the downlight 40. FIG. 5 is a first perspective view of the downlight 40. FIG. 6 is a second perspective view of the downlight 40.

The light engine in the downlight 40 depicted in FIGS. 4-6 comprises a light engine housing that comprises a mixing chamber element 41, a driver chamber element 42 and a connection element 43.

The light engine in the downlight 40 depicted in FIGS. 4-6 is similar to the light engine 10 depicted in FIGS. 1-3, except that a trim element 44 is attached to the connection element 43, and there is provided an electrical connector 45 in the form of a wire that can be connected to a terminal, another wire, or any other kind of electrical connector.

Two screws 46 and 47 extend through at least a portion of the mixing chamber element 41 and at least a portion of the driver chamber element 42 to connect the mixing chamber element 41 and the driver chamber element 42 to each other. The downlight 40 further comprises a mixing chamber module 48.

Figure 8:
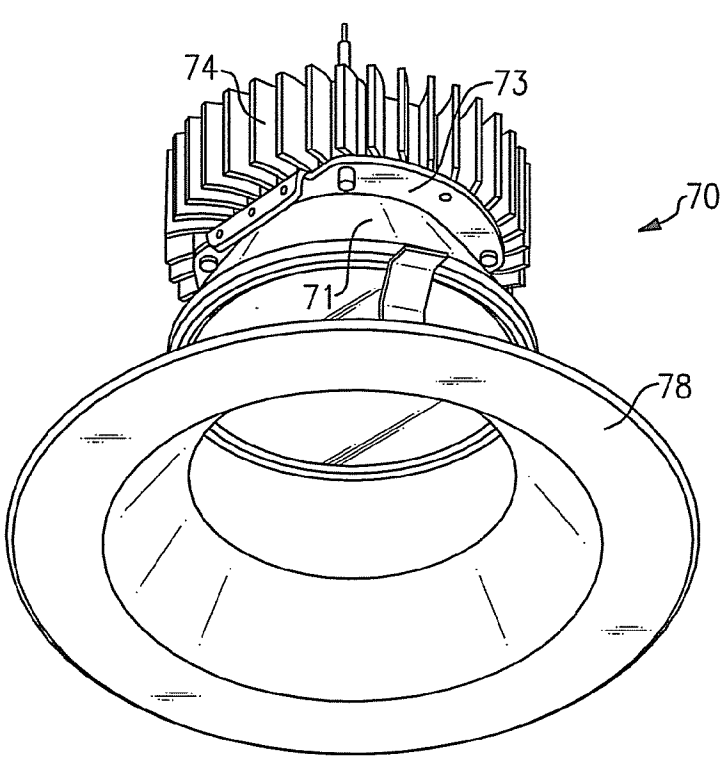
FIG. 8 is a second perspective view of the downlight 70.
Figure 7:
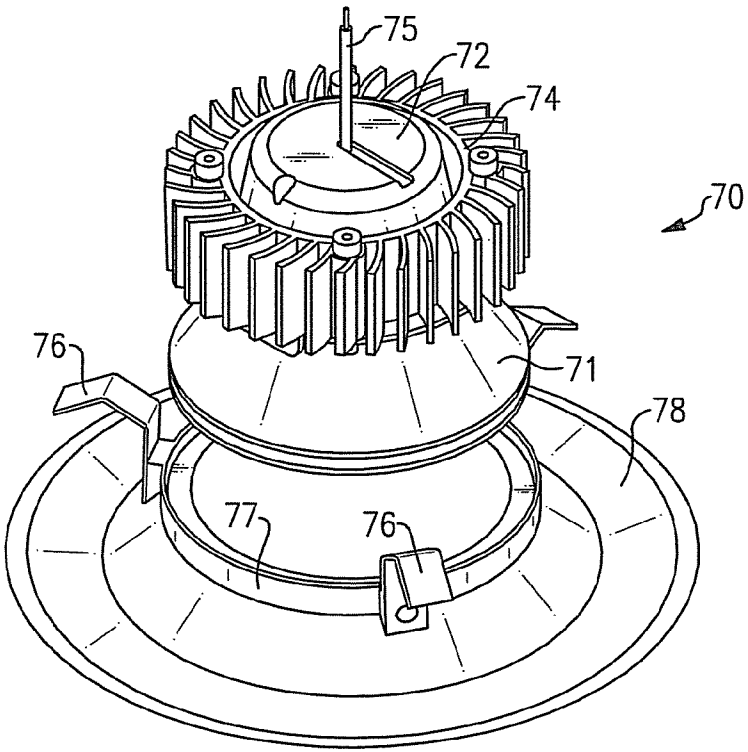
FIG. 7 is a first perspective view of a downlight 70

FIGS. 7-8 illustrate a downlight 70 in accordance with the present inventive subject matter, for use in, e.g., a ceiling recessed downlight with an extrusion heat sink. FIG. 7 is a first perspective view of the downlight 70, and FIG. 8 is a second perspective view of the downlight 70.

The light engine in the downlight 70 depicted in FIGS. 7-8 comprises a light engine housing that comprises a mixing chamber element 71, a driver chamber element 72 and a connection element 73.

The light engine in the downlight 70 depicted in FIGS. 7-8 is similar to the light engine 10 depicted in FIGS. 1-3, except that a heat sink element 74 is attached to the connection element 73, and there is provided an electrical connector 75 in the form of a wire that can be connected to a terminal, another wire, or any other kind of electrical connector. The light engine is shown in FIGS. 7-8 in position to be attached to a trim element 78 that comprises clamps 76 and a rim 77 that can engage the mixing chamber element 71.

Figure 9:
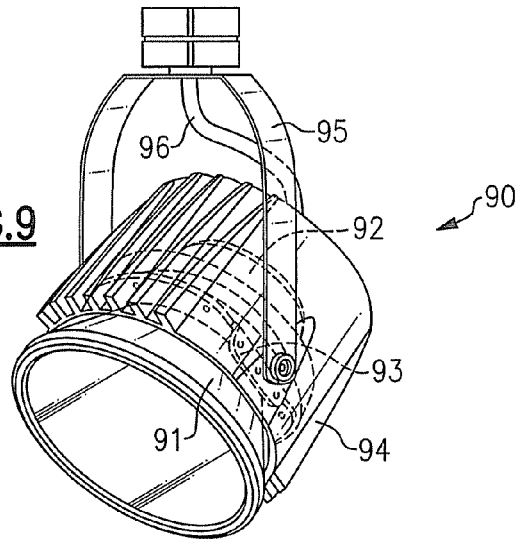
FIG. 9 is a view, partially in phantom, showing the exterior as well as part of the interior, of a track head 90.
Figure 10:
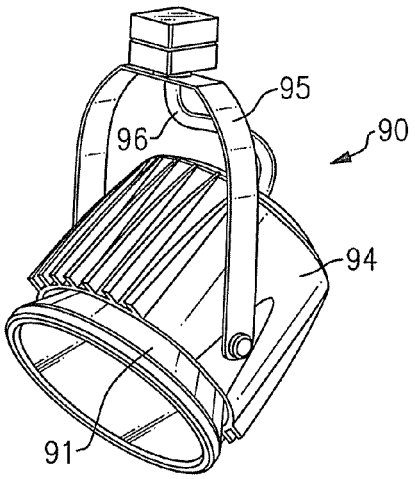
FIG. 10 is a first perspective view of the track head 90.
Figure 11:
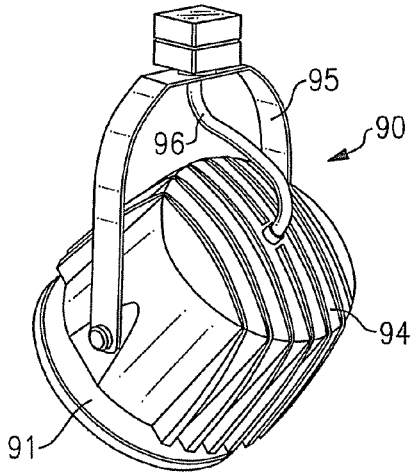
FIG. 11 is a second perspective view of the track head 90.

FIGS. 9-11 illustrate a track head 90 in accordance with the present inventive subject matter. FIG. 9 is a view, partially in phantom, showing the exterior as well as part of the interior, of the track head 90. FIG. 10 is a first perspective view of the track head 90. FIG. 11 is a second perspective view of the track head 90.

The light engine in the track head 90 depicted in FIGS. 9-11 comprises a light engine housing that comprises a mixing chamber element 91, a driver chamber element 92 and a connection element 93.

The light engine in the track head 90 depicted in FIGS. 9-11 is similar to the light engine 10 depicted in FIGS. 1-3, except that a fixture housing 94 is attached to the connection element 93, a bracket 95 is attached to the fixture housing 94 and an electrical connector sleeve 96 is connected to the driver chamber element 92.

Figure 13:
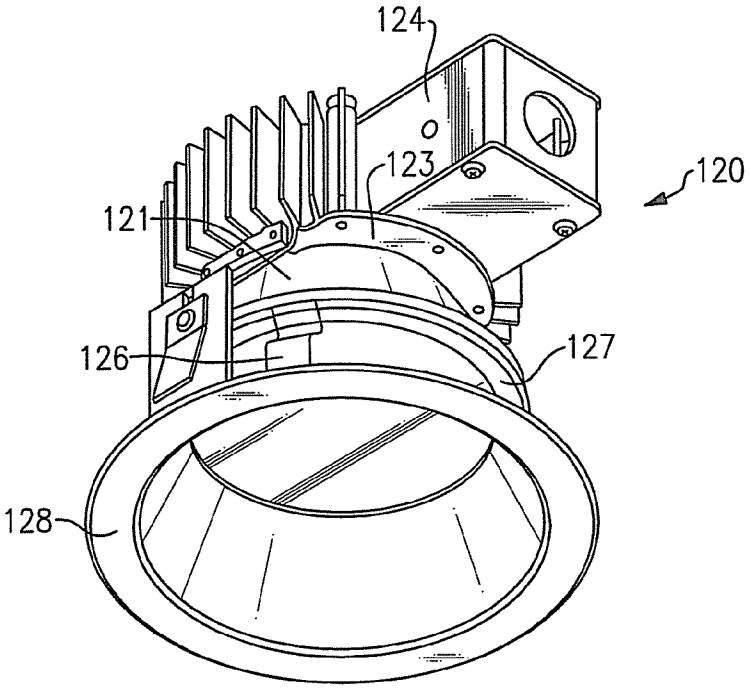
FIG. 13 is a second perspective view of the downlight 120.
Figure 12:
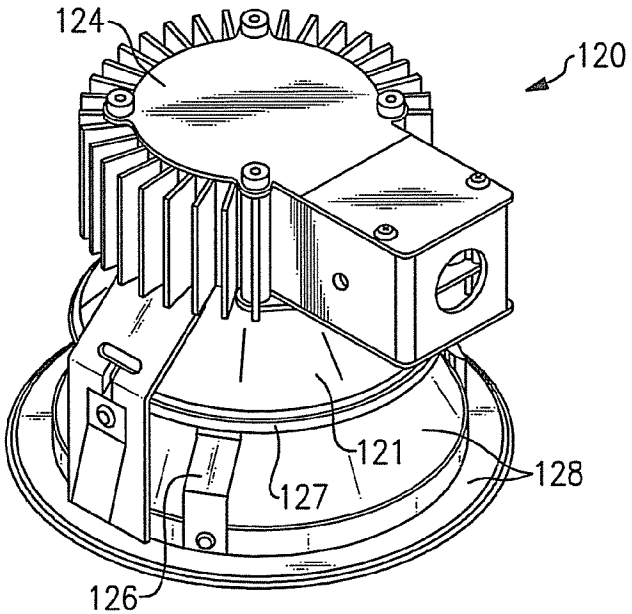
FIG. 12 is a first perspective view of a downlight 120.
Figure 14:
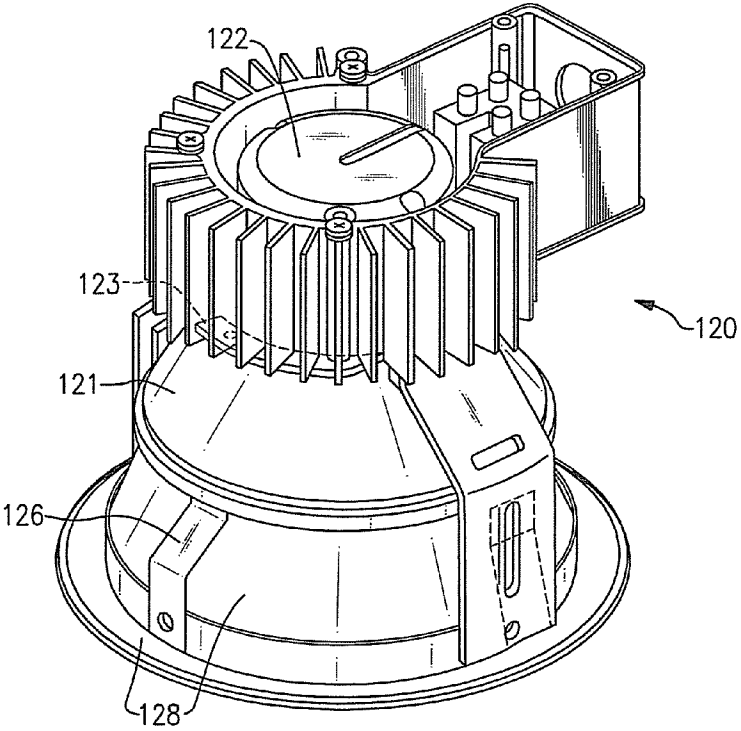
FIG. 14 is a view, partially in phantom, showing the exterior as well as part of the interior, of the downlight 120.

FIGS. 12-14 illustrate a downlight 120 in accordance with the present inventive subject matter, for use in, e.g., a low-profile ceiling recessed downlight. FIG. 12 is a first perspective view of the downlight 120. FIG. 13 is a second perspective view of the downlight 120. FIG. 14 is a view, partially in phantom, showing the exterior as well as part of the interior, of the downlight 120.

The light engine in the downlight 120 depicted in FIGS. 12-14 comprises a light engine housing that comprises a mixing chamber element 121, a driver chamber element 122 and a connection element 123.

The light engine in the downlight 120 depicted in FIGS. 12-14 is similar to the light engine 10 depicted in FIGS. 1-3, except that a heatsink 124 that encloses a power supply and provides an enclosed cavity for a /junction box is attached to the connection element 123, and a trim element 128 is attached to the mixing chamber element 121 with clamps 126 and a rim 127.

Figure 15:
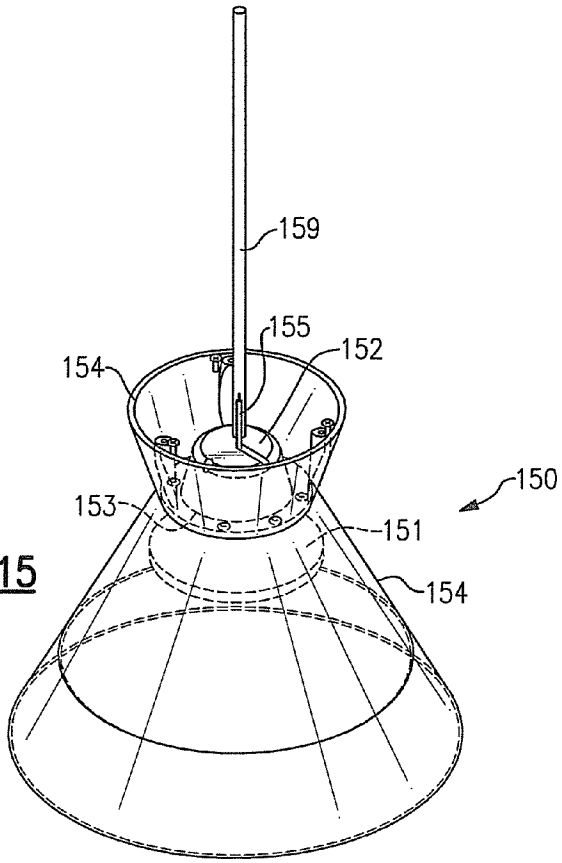
FIG. 15 is a view, partially in phantom, showing the exterior as well as part of the interior, of a ceiling pendant light 150.
Figure 16:
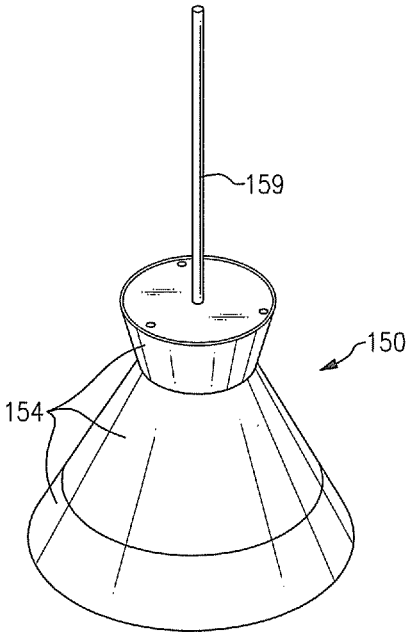
FIG. 16 is a first perspective view of the ceiling pendant light 150.
Figure 17:
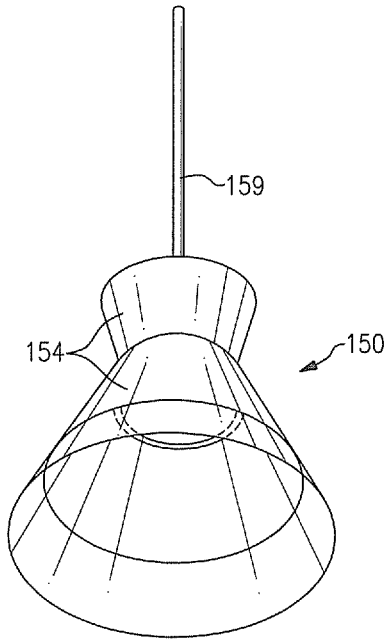
FIG. 17 is a second perspective view of the ceiling pendant light 150.

FIGS. 15-17 illustrate a ceiling pendant light 150 in accordance with the present inventive subject matter. FIG. 15 is a view, partially in phantom, showing the exterior as well as part of the interior, of the pendant light 150. FIG. 16 is a first perspective view of the pendant light 150. FIG. 17 is a second perspective view of the pendant light 150.

The light engine in the pendant light 150 depicted in FIGS. 15-17 comprises a light engine housing that comprises a mixing chamber element 151, a driver chamber element 152 and a connection element 153.

The light engine in the pendant light 150 depicted in FIGS. 15-17 is similar to the light engine 10 depicted in FIGS. 1-3, except that a trim element 154 is attached to the connection element 153, and there is provided an electrical connector 155 in the form of a wire that can be connected to, e.g., another wire, inside a pendant mount 159 (or that can be connected to a pendant cord).

As displayed in FIGS. 4-17, light engines according to the present inventive subject matter can readily be attached to a variety of modules in order to build a variety of lighting devices, e.g., various downlights, track lighting devices, pendants lights, etc. In an analogous way, any other suitable modules can be connected to the light engines according to the present inventive subject matter in order to build any other desired lighting device, e.g., a ceiling surface (surface mount) lighting device, a wall surface (single wall mount) lighting device, a pole light, or any other conventional or unconventional lighting device.

Figure 18:
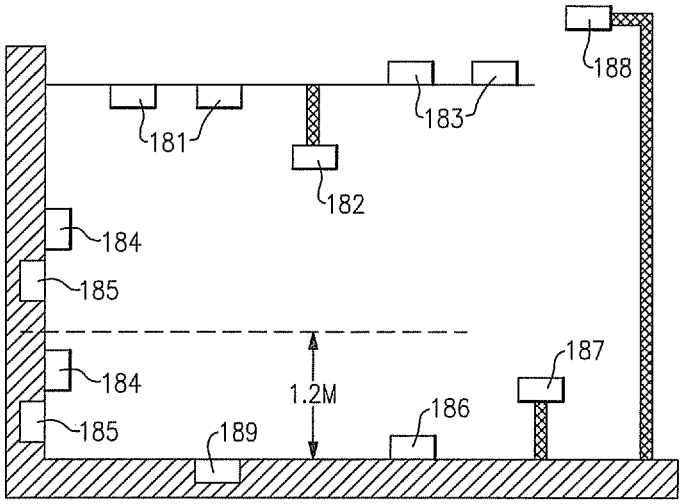
FIG. 18 is a schematic drawing depicting a variety of mounting locations.

Light engines according to the present inventive subject matter, and/or lighting devices that include light engines according to the present inventive subject matter, can be installed in any suitable location. As representative examples of typical installation locations, FIG. 18 is a schematic drawing depicting a variety of mounting locations, including two ceiling surface locations 181 (one covered, one not covered), a ceiling pendant location 182, two ceiling-recessed locations 183 (one covered, one not covered), two wall surface locations 184 (one above 1.2 meters on the wall, one below 1.2 meters on the wall), two wall-recessed locations 185 (one above 1.2 meters on the wall, one below 1.2 meters on the wall), a ground-mounted surface location 186, a pole or post location 187, an overhead location 188, and a ground-mounted recessed location 189. For example, a wall surface (single wall mount) lighting device can be installed in the upper location 184; a ceiling surface (surface mount) lighting device can be installed in the locations 181; a ceiling pendant lighting device can be installed in the location 182; a ceiling recessed downlight can be installed in the locations 183; a pole light can be installed in the location 187, etc.

In any light engine in accordance with the present inventive subject matter, the solid state light emitter, or one or more of the solid state light emitters, can be mounted directly on a mixing chamber element, if included, and/or on a trim element, if included. In such devices, power can be delivered to the solid state light emitter or solid state light emitters that is/are mounted directly on the mixing chamber element and/or on the trim element in any suitable way, e.g., through conductive traces provided on the mixing chamber element and/or on the trim element, through wires connected to one or more circuit boards, through traces embedded in the mixing chamber element and/or the trim element, through contacts that extend through the mixing chamber element and/or the trim element, etc.

Mounting solid state light emitters directly on a mixing chamber element and/or on a trim element can reduce or minimize the thermal interfaces between the solid state light emitters and the ambient environment where the mixing chamber element and/or trim element acts as a heat sink for the solid state light emitters and is exposed to a room. Mounting solid state light emitters directly on a mixing chamber element and/or on a trim element can also eliminate the cost of a metal core circuit board. In other devices, one or more solid state light emitters could be mounted on a circuit board (e.g., a metal core circuit board) that is mounted on a mixing chamber element and/or on a trim element.

In some light engines in which the solid state light emitter or one or more of the solid state light emitters is/are mounted directly on a mixing chamber element, one or more thermal element can be provided that is on the mixing chamber element in a location where it can serve a specific solid state light emitter or group of solid state light emitters. A representative example of a suitable thermal element is a projection that extends from the side of a mixing chamber element that is opposite the side on which the solid state light emitter(s) is/are mounted. Alternatively or additionally a portion of the heat sink adjacent to the solid state light emitter (or solid state light emitters) can be removed (and optionally filled with a thermal element or a part of a thermal element). A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the light engines described herein can be integrated. Any structural part of the light engines described herein can be provided in two or more parts (which may be held together in any known way, e.g., with adhesive, screws, bolts, rivets, staples, etc.).

The invention claimed is:

1. A light engine housing comprising:
a mixing chamber element;
a driver chamber element;
a connection element; and
at least one connector, the at least one connector removably attaching the mixing chamber element and the driver chamber element to the connection element, the mixing chamber element movable relative to the driver chamber element upon removal of the at least one connector.

2. A light engine comprising a light engine housing as recited in claim 1 and a driver module which is removably attached to the light engine housing.

3. A light engine housing as recited in claim 1, wherein the mixing chamber element at least in part defines a mixing chamber in which light from at least one solid state light emitter mixes prior to exiting the light engine housing.

4. A light engine comprising a light engine housing as recited in claim 1 and at least a first lens, a mixing chamber defined at least in part by the mixing chamber element and the first lens.

5. A light engine comprising a light engine housing as recited in claim 1 and at least a first diffuser, a mixing chamber defined at least in part by the mixing chamber element and the first diffuser.

6. A lighting device, comprising a light engine housing as recited in claim 1 and at least one structure selected from among (1) fixture elements, (2) trim elements and (3) heat sinks.

7. A light engine comprising a light engine housing as recited in claim 1 and at least one solid state light emitter.

8. A light engine housing as recited in claim 1, wherein the driver chamber element defines a driver compartment that has a size and shape that accommodate at least one component selected from among (1) driver components and (2) power supply components.

9. A light engine comprising a light engine housing as recited in claim 1 and at least one component selected from among (1) driver components and (2) power supply components.

10. A light engine comprising:
a light engine housing; and
a mixing chamber module, the mixing chamber module removably attached to the light engine housing,
the light engine housing comprising at least a first connection element, the first connection element comprising at least first and second regions, the first region configured to receive a connector that has an axis that extends in a first direction the second region configured to receive a connector that has an axis that extends in a second direction, the second direction differing from the first direction, the first connection element further comprising a region inside a space defined by the light engine housing.

11. A light engine as recited in claim 10, wherein the light engine further comprises a driver module.

12. A light engine comprising:
a light engine housing;
a mixing chamber module;
a driver module; and
a connection element,
the connection element between the mixing chamber module and the driver module, the mixing chamber module removably attached to the connection element, the driver module removably attached to the connection element,
the connection element comprising at least first and second mounting surfaces the first mounting surface and the second mounting surface non-parallel with each other, the connection element further comprising a third region, an axis of the light engine housing extending through the third region.

13. A light engine housing comprising:
at least a first connection element;
a mixing chamber element; and
a driver chamber element,
the mixing chamber element and the driver chamber element attached to the first connection element,
the first connection element configured to connect to at least one structure selected from among (1) trim elements, (2) fixture elements and (3) heat sinks,
the first connection element comprising at least first and second mounting surfaces, the first mounting surface and the second mounting surface non-parallel.

14. A light engine housing as recited in claim 13, wherein the first connection element comprises at least first and second apertures, the first aperture having an axis that extends in a first direction, the second aperture having an axis that extends in a second direction, the first direction differing from the second direction.

15. A light engine housing as recited in claim 14, wherein the mixing chamber element at least in part defines a mixing chamber in which light from at least one solid state light emitter mixes prior to exiting the light engine housing.

16. A light engine housing as recited in claim 14, wherein at least one of the axis of the first aperture and the axis of the second aperture is substantially parallel to an axis of the light engine housing.

17. A light engine housing as recited in claim 14, wherein at least one of the axis of the first aperture and the axis of the second aperture is substantially perpendicular to an axis of the light engine housing.

18. A light engine housing as recited in claim 14, wherein the driver chamber element defines a driver compartment that has a size and shape that accommodate at least one component selected from among (1) driver components and (2) power supply components.

19. A light engine comprising a light engine housing as recited in claim 14 and at least one component selected from among (1) driver components and (2) power supply components in the driver chamber element.

20. A lighting device, comprising a light engine housing as recited in claim 13 and at least one electrical connector.

21. A light engine comprising a light engine housing as recited in claim 14 and at least a first lens, a mixing chamber defined at least in part by the mixing chamber element and the first lens.

22. A lighting device, comprising a light engine housing as recited in claim 13 and at least one structure selected from among (1) fixture elements, (2) trim elements and (3) heat sinks.

23. A lighting device as recited in claim 22, wherein the at least one structure selected from among (1) fixture elements, (2) trim elements and (3) heat sinks is attached to the first connection element.

24. A light engine comprising a light engine housing as recited in claim 13 and at least one component selected from among (1) driver components and (2) power supply components.

25. A light engine comprising a light engine housing as recited in claim 13 and at least a first diffuser, a mixing chamber defined at least in part by the mixing chamber element and the first diffuser.

26. A light engine comprising a light engine housing as recited in claim 13 and at least one solid state light emitter.

27. A light engine housing as recited in claim 13, wherein the mixing chamber element at least in part defines a mixing chamber in which light from at least one solid state light emitter mixes prior to exiting the light engine housing.

28. A light engine housing as recited in claim 13, wherein at least one of the first and second mounting surfaces defines a plane with respect to which an axis of the light engine housing is substantially parallel.

29. A light engine housing as recited in claim 13, wherein at least one of the first and second mounting surfaces defines a plane that is substantially perpendicular to an axis of the light engine housing.

30. A light engine housing as recited in claim 13, wherein at least a first aperture is formed in the first mounting surface and at least a second aperture is formed in the second mounting surface, the first aperture having an axis that extends in a first direction, the second aperture having an axis that extends in a second direction, the first direction differing from the second direction.

31. A light engine housing as recited in claim 13, wherein the driver chamber element defines a driver compartment that has a size and shape that accommodate at least one component selected from among (1) driver components and (2) power supply components.

32. A lighting device, comprising a light engine housing as recited in claim 13 and at least one structure selected from among (1) fixture elements, (2) trim elements and (3) heat sinks.

33. A lighting device as recited in claim 32, wherein the at least one structure selected from among (1) fixture elements, (2) trim elements and (3) heat sinks is attached to the first connection element.

34. A light engine comprising a light engine housing as recited in claim 13 and at least one component selected from among (1) driver components and (2) power supply components.

35. A light engine comprising a light engine housing as recited in claim 13 and at least one component selected from among (1) driver components and (2) power supply components in the driver chamber element.

36. A light engine comprising a light engine housing as recited in claim 13 and at least one solid state light emitter.

37. A lighting device comprising a light engine housing as recited in claim 13 and at least one other component, wherein the connection element provides both mechanical connection and thermal coupling between the light engine housing and the at least one other component.

38. A light engine housing as recited in claim 37, wherein the at least one other component is selected from among (1) fixture elements, (2) trim elements and (3) heat sinks.

39. A light engine comprising:

a light engine housing; and at least one solid state light emitter, the light engine housing comprising a mixing chamber element, a driver chamber element and at least a first connection means for connecting at least one component selected from among (1) trim elements, (2) fixture elements and (3) heat sinks to the light engine, the mixing chamber element and the driver chamber element both removably attached to the first connection means, the first connection means comprising at least first and second mounting surfaces, the first mounting surface and the second mounting surface non-parallel with each other, the first connection means further comprising a third region, an axis of the light engine housing extending through the third region.

40. A light engine as recited in claim 39, wherein the mixing chamber element at least in part defines a mixing chamber in which light from the at least one solid state light emitter mixes prior to exiting the light engine housing.

41. A light engine housing, comprising:

a mixing chamber element;

a driver chamber element; and at least a first connection element, the light engine housing configured to removably attach any structure selected from among (1) heat sinks, (2) trim elements and (3) fixture elements, the first connection element comprising at least first and second mounting surfaces, the first mounting surface and the second mounting surface non-parallel with each other, the first connection element further comprising a third region, an axis of the light engine housing extending through the third region.

42. A light engine housing as recited in claim 41, wherein the first connection element is configured to attach at least one structure selected from among (1) heat sinks and (2) fixture elements.

43. A light engine housing as recited in claim 41, wherein the mixing chamber element and the driver chamber element are both part of a single unitary structure.

44. A light engine housing as recited in claim 41, wherein the mixing chamber element and the driver chamber element are separate structures.

45. A lighting device, comprising a light engine housing as recited in claim 41 and at least one structure selected from among (1) fixture elements, (2) trim elements and (3) heat sinks attached to the light engine housing.

46. A light engine, comprising:

a light engine housing that comprises a removable mixing chamber element, a removable driver chamber element and at least a first connection element, the light engine further comprising at least one of a mixing chamber module in the mixing chamber element and a driver module in the driver chamber element, the first connection element comprising at least first and second mounting surfaces, the first mounting surface and the second mounting surface non-parallel with each other, the first connection element further comprising a third region, an axis of the light engine housing extending through the third region.

47. A light engine, comprising:

a light engine housing that comprises a removable mixing chamber element and, a removable driver chamber element and at least a first connection element, the driver chamber element configured to removably receive at least one driver component, the first connection element comprising at least first and second regions, the first region configured to receive a connector that has an axis that extends in a first direction, the second region configured to receive a connector that has an axis that extends in a second direction, the second direction differing from the first direction, the first connection element further comprising a region inside a space defined by the light engine housing.

48. A light engine housing, comprising:

at least a first connection element, the first connection element comprising at least first and second regions, the first region configured to receive a connector that has an axis that extends in a first direction, the second region configured to receive a connector that has an axis that extends in a second direction, the second direction differing from the first direction, the first connection element further comprising a region inside a space defined by the light engine housing.

49. A light engine housing as recited in claim 48, wherein the first region comprises an aperture.

50. A light engine housing as recited in claim 49, wherein the aperture has an axis that is substantially parallel to an axis of the light engine housing.

51. A light engine housing as recited in claim 49, wherein the aperture has an axis that is substantially perpendicular to an axis of the light engine housing.

52. A light engine housing, comprising:

at least a first connection element, the first connection element comprising at least first and second mounting surfaces, the first mounting surface and the second mounting surface non-parallel with each other, the first connection element further comprising a third region, an axis of the light engine housing extending through the third region.

53. A light engine housing as recited in claim 52, wherein the first mounting surface comprises an aperture.

54. A light engine housing as recited in claim 53, wherein the aperture has an axis that is substantially parallel to an axis of the light engine housing.

55. A light engine housing as recited in claim 53, wherein the aperture has an axis that is substantially perpendicular to an axis of the light engine housing.

* * * * *

UNITED STATES PATENT AND TRADEMARK OFFICE

CERTIFICATE OF CORRECTION

PATENT NO. : 9,068,719 B2
APPLICATION NO. : 12/566857
DATED : June 30, 2015
INVENTOR(S) : Antony Paul Van De Ven, Charles M. Swoboda and Wai Kwan Chan It is certified that error appears in the above-identified patent and that said Letters Patent is hereby corrected as shown below:

In the specification

Col. 4, Lines 9 - 11

Please change: "comprise a light engine housing, and a modular mixing chamber element (i.e., a mixing chamber module) and/or a modular driver chamber element (i.e., a driver chamber module)," to -- comprise a light engine housing, and a modular mixing chamber module and/or a modular driver module, --

Col. 4, Lines 14 - 15

Please change: "chamber elements, and/or one or more of a wide variety of driver chamber elements, in order to provide a lighting device" to -- chamber modules, and/or one or more of a wide variety of driver modules, in order to provide a lighting device --

Col. 4, Lines 22 - 24

Please change: "comprise a light engine housing, and a mixing chamber element that is removably attached to the light engine housing and/or a driver chamber element that is removably attached to" to -- comprise a light engine housing, and a mixing chamber module that is removably attached to the light engine housing and/or a driver module that is removably attached to --

Col. 4, Line 26

Please change: "element that is removable and/or a driver chamber element" to -- module that is removable and/or a driver module --

Signed and Sealed this
Twenty-ninth Day of December, 2015

Michelle K. Lee

Michelle K. Lee
*Director of the United States Patent and Trademark Office*

In the specification

Col. 4, Lines 29 - 31

Please change: "driver chamber elements can readily be interchanged (i.e., can be selectively combined with the light engine or the lighting device) in order to accommodate the components" to -- driver modules can readily be interchanged (i.e., can be selectively combined with the light engine housing) in order to accommodate the components --

Col. 4, Line 44

Please change: "embodiments, the light engine housing further comprises a" to
-- embodiments, the light engine housing comprises a --

Col. 4, Line 46

Please change: "some embodiments in which the light engine housing further" to
-- some embodiments in which the light engine housing --

Col. 4, Line 48

Please change: "element at least in part defining a mixing chamber. In some" to
-- element can at least in part define a mixing chamber. In some --

Col. 4, Line 52

Please change: "mixing chamber element, a driver chamber element, a fixture" to
-- mixing chamber module, a driver module, a fixture --

Col. 4, Line 56

Please change: "housing to which a variety of mixing chamber elements can" to
-- housing to which a variety of mixing chamber modules can --

Col. 4, Lines 58 - 59

Please change: "driver chamber elements can be interchangeably connected (and/or in which a variety of mixing chamber elements can be" to -- driver modules can be interchangeably connected (and/or in which a variety of mixing chamber modules can be --

In the specification

Col. 4, Line 61

Please change: "chamber elements can be interchangeably positioned)." to -- modules can be interchangeably positioned). --

Col. 5, Line 19

Please change: "features described herein, the first connection element has at" to -- features described herein, a first connection element is provided which has at --

Col. 5, Line 25

Please change: "of the second apertures is substantially parallel to an axis of" to -- of the second aperture is substantially parallel to an axis of --

Col. 5, Line 27

Please change: "first aperture and the axis of the second apertures is substan-" to -- first aperture and the axis of the second aperture is substan- --

Col. 5, Line 31

Please change: "features described herein, the first connection element has at" to -- features described herein, a first connection element is provided which has at --

Col. 5, Line 46

Please change: "from the second direction." to -- from (i.e., not being identical to or parallel to) the second direction. --

Col. 5, Line 55

Please change: "power supply components is/are positioned within the driver" to -- power supply components is/are positioned within a driver --

Col. 10, Line 54

Please change: "engine housing further comprises a mixing chamber element" to -- engine housing comprises a mixing chamber element --

In the specification

Col. 17, Line 43

Please change: "elements to be easily attached to the light engine." to -- elements to the light engine --

Col. 26, Line 5

Please change: "emitting diodes 14 (see FIG. 3) The light emitting diodes 14" to -- emitting diodes 14 (see FIG. 3). The light emitting diodes 14 --

Col. 26, Line 12

Please change: "mixes prior to exiting the light engine housing 10." to -- mixes prior to exiting the light engine housing. --

Col. 27, Line 28

Please change: "provides an enclosed cavity for a /junction box is attached to" to -- provides an enclosed cavity for a junction box is attached to --

Col. 27, Line 51

Please change: "variety of modules in order to build a variety of lighting" to -- variety of modules and/or elements in order to build a variety of lighting --

Col. 27, Line 54

Please change: "modules can be connected to the light engines according to" to -- modules and/or elements can be connected to the light engines according to --

In the claims

Claim 10, Col. 30, Line 5

Please change: "first direction the second region configured to receive a" to -- first direction, the second region configured to receive a --

Claim 12, Col. 30, Line 23

Please change: "mounting surfaces the first mounting surface and the" to -- mounting surfaces, the first mounting surface and the --